US006435850B2

(12) United States Patent
Sunaga et al.

(10) Patent No.: US 6,435,850 B2
(45) Date of Patent: Aug. 20, 2002

(54) ROTARY COMPRESSOR

(75) Inventors: Takashi Sunaga, Ora-Machi; Kenzo Matsumoto; Manabu Takenaka, both of Ozumi-Machi; Masazo Okajima, Sano, all of (JP)

(73) Assignee: Sanyo Electric Co., Ltd., Gunma-ken (JP)

( * ) Notice: Subject to any disclaimer, the term of this patent is extended or adjusted under 35 U.S.C. 154(b) by 0 days.

(21) Appl. No.: 09/790,745

(22) Filed: Feb. 22, 2001

(30) Foreign Application Priority Data

Mar. 15, 2000 (JP) ..... 2000-071619

(51) Int. Cl.[7] ..... F04C 18/00
(52) U.S. Cl. ..... 418/63; 418/178; 418/179
(58) Field of Search ..... 418/63, 178, 179

(56) References Cited

U.S. PATENT DOCUMENTS 5,090,882 A * 2/1992 Serizawa et al. ..... 418/63
5,273,410 A * 12/1993 Kitaichi et al. ..... 418/179
5,518,381 A * 5/1996 Matsunaga et al. ..... 418/100
5,685,703 A * 11/1997 Fukuoka et al. ..... 418/63
5,951,273 A * 9/1999 Matsunaga et al. ..... 418/63
6,132,195 A * 10/2000 Ikoma et al. ..... 418/63
6,139,296 A * 10/2000 Okajima et al. ..... 418/63

FOREIGN PATENT DOCUMENTS

JP 08-042473 * 2/1996 ..... 418/63

* cited by examiner

*Primary Examiner*—Thomas Denion
*Assistant Examiner*—Theresa Trieu
(74) *Attorney, Agent, or Firm*—J.C. Patents

(57) ABSTRACT

A rotary compressor uses a freon without containing chlorine ions and uses polyol ester as a lubricant or plyvinyl ether as a base oil for providing a highly reliable rotary compressor, and for preventing abnormal abrasion. The rotary compressor has a roller and a vane sliding contact with an outer cirumference of the roller. A sliding contact portion between the vane and the roller is formed with a radius of curvature Rv, and satisfies T<Rv<Rr, wherein T is the thickness of the vane and Rr is the radius of curvature of the outer circumference of the roller.

12 Claims, 5 Drawing Sheets

ROTARY COMPRESSOR

CROSS-REFERENCE TO RELATED APPLICATION

This application claims the priority benefit of Japanese application serial no. 2000-071619, filed Mar. 15, 2000.

BACKGROUND OF THE INVENTION

1. Field of the Invention

This invention relates in general to a rotary compressor using a freon without containing chlorine ions, and using polyol ester as a lubricant or plyvinyl ether as a base oil for preventing abnormal abrasion, and more specifically relates to a structure of a vane and a roller of a highly reliable rotary compressor.

2. Description of Related Art

Traditionally, the freon used for most compressors within refrigerators, showcases, vending machines, or air-conditioners for family and businesses are dichrolrodifluoromethane (R12) and monochrolrodifluoromethane (R22). The traditional freons R12 and R22 easily damage the ozone layer when they are released into the atmosphere. Consequently, use of the traditional freon is restricted. Damage to the ozone layer of the atmosphere is due to chlorine components in the freon. Therefore, a natural freon without chlorine ions, such as HFC freon (for example, R32, R125, and R134*a*), phytane type freon (for example, propane and butane etc.), carbonic acid gas and ammonia etc, is considered to replace the traditional freon.

FIG. 1 is a cross-sectional view of a rotary compressor with two cylinders, FIG. 2 is a diagram for showing a structural correlation among a roller, a vane and a cylinder, FIG. 3 is a diagram for showing a vane structure. As shown in FIG. 1, the rotary compressor 1 comprises a sealed container 10 with an electromotor and a compressor both installed within the sealed container 10. The electromotor 20 includes a stator 22 and a rotor 24, both of which are fixed on inner walls of the sealed container 10. A rotary shaft 25 passing through the center of the rotor 24 is freely rotated to support two plates 33, 34 that are used to seal the openings of the cylinders 31, 32. A crank 26 is eccentrically connected to the rotary shaft 25. The cylinders 31, 32 are mounted between the two plates 33, 34. The axes of the two cylinders 31, 32 are aligned with the axis of the rotary shaft 25. Hereinafter, only the cylinder 32 is described for simplification. At the sidewall 32*b* of the cylinder 32, a freon inlet 23 and a freon outlet 35 are formed respectively.

Within the cylinder 32, an annular roller 38 is mounted. The inner circumference 38*b* of the roller 38 is in contact with the outer circumference 26*a* of the crank 26, and the outer circumference 38*a* of the roller 38 is in contact with the inner circumference 32*b* of the cylinder 32. A vane 40 is mounted on the cylinder 32 and capable of sliding freely. The front end 40*a* of the vane 40 is elastically in contact with the outer circumference 38*a* of the roller 38. The front end 40*a* of the vane 40 and the roller 38 are securely sealed by introducing a compressed freon from the vane 40. A compressing room 50 is then encompassed by the roller 38, the cylinder 32, and the plate 34 for sealing the cylinder 32.

When the rotary shaft 25 rotates counterclockwise with respect to FIG. 2, the roller 38 rotates eccentrically within the cylinder 32. Therefore, freon gas is introduced into the compressing room 50 from the inlet 23, compressed and then exhausted from the outlet 35. During the cycle, a compressing stress Fv is generated at the contact portion of the vane 40 and the roller 38.

According to the traditional structure, the contact surface (the front end) 40*a* of the vane 40 in contact with the roller

38 is an arc shape with a radius of curvature Rv. The radius of curvature Rv is substantially equal to the width of the vane 40, and about 1/10 to 1/3 of the radius of the roller 38. The roller 38 is made of materials such as cast iron or cast iron alloy, and is formed by a quenching process. The vane 40 is made of materials such as stainless steel or tool steel, and can be further coated by nitridation. In general, the vane 40 is characterized by high hardness and malleability.

FIG. 4 shows the contact status between the roller 38 and the vane, however a cylindrical tube with different radius of curvature can be used. As shown in FIG. 4, due to the compressing stress Fv of the vane 40, it is a surface contact, rather than a point contact or a line contact, between the vane 40 and the roller 38 when they squeeze each other. The length of an elastic contact surface between the vane 40 and the roller 38 can be calculated by the following formula:

$$d = 4\sqrt{\left(\frac{1-\nu_1^2}{\pi E1} + \frac{1-\nu_2^2}{\pi E2}\right)\cdot Fv\cdot\frac{\rho}{L}}$$

wherein E1 and E2 are longitudinal elastic coefficients (kg/cm2) for the vane 40 and the roller 38 respectively, ν1 and ν2 are Poisson's ratios for the vane 40 and the roller 38 respectively, L is the height (cm) of the vane 40, Fv is the compressing stress, ρ is a effective radius. At the contact portion, a Hertz stress Pmax (kgfcm2) is exerted and calculated by the following formula:

$$Pmax=4/\pi\cdot Fv/L/d \tag{9}$$

As the structure described above, in order to increase the durability of the vane a surface process such as a nitridation process or a CrN ion coating film is performed on the vane of the rotary compressor using a freon without containing chlorine ions and using a polyol ester lubricant or plyvinyl ether as a base oil. However, the durability for nitridation is easily degraded and the CrN ion film is easily stripped. Furthermore, the nitridation process or the CrN ion coating film costs high and therefore the manufacturing cost increases.

SUMMARY OF THE INVENTION

According to the foregoing description, an object of this invention is to provide a high reliable rotary compressor using a freon without containing chlorine ions, and using a polyol ester as a lubricant or plyvinyl ether as a base oil for preventing abnormal abrasion between the vane and the roller.

According to the present invention, it changes the conventional design that the radius of curvature of the contact surface of the vane and the roller is substantially equal to the width of the vane. To maintain the contact surface of the vane and the roller within an acceptable range, by increasing the radius of curvature of the contact surface to be larger than the width of the vane, the Hertz stress is therefore decreased. In addition, the sliding distance increases for diverging the stress such that the temperature at the sliding contact portion between the vane and the roller can be reduced. Accordingly, a coating process with a high cost is not necessary for the surface of the vane. Namely, even though a low cost nitridation (NV nitridation, sulphonyl nitridation or radical nitridation) is used, it can sufficiently reduce the abrasion between the contact area of the roller and the vane, and further prevent abnormal abrasion.

According to the objects mentioned above, the present invention provides a rotary compressor coupled to a freon loop. The freon loop is connected to the rotary compressor, a condenser, an expansion device and an evaporator. The rotary compressor uses a freon without containing chlorine ions and uses a polyol ester as a lubricant or polyvinyl ether as a base oil for the lubricant. The rotary compressor comprises at least a cylinder, a rotary shaft, a roller and a vane. The cylinder has a freon inlet and a freon outlet. The rotary shaft has a crank installed on an axis of the cylinder. The roller is installed between the crank and the cylinder, and capable of eccentrically rotating. The vane is capable of reciprocating within a groove formed in the cylinder, and sliding contact with an outer circumference of the roller. A sliding contact portion is formed between the vane and the roller, having a radius of curvature Rv satisfying the following formula:

$$T<Rv<Rr \quad (1)$$

wherein T is the thickness of the vane and Rr is the radius of curvature of the outer circumference of the roller sliding contact with the vane.

As mentioned, a distance between a rotation center (O1) of the rotary shaft and a center (O2) of the roller is defined as an eccentricity (E). An angle α is formed between a first line (L1) and a second line (L2), in which the first line (L1) connects the center (O2) of the roller and a center (O3) of the radius of curvature Rv of the vane, and the second line (L2) connects the center (O3) of the radius of curvature Rv of the vane and the rotation center (O1) of the rotary shaft. A sliding distance connects a first intersection of the first line (L1) with the outer circumference of the roller and a second intersection of the second line (L2) with the outer circumference of the roller. The thickness T, the radii of curvature Rv, Rr, the eccentricity E, the angle α, and the sliding distance (ev) satisfy the following formulae for maintaining a sliding contact surface located at the sliding contact portion between the vane and the roller:

$$T>2\cdot Rv\cdot E/(Rv+Rr) \quad (2)$$

$$\sin\alpha=E/(Rv+Rr) \quad (3)$$

$$ev=Rv\cdot E/(Rv+Rr) \quad (4)$$

In addition, the thickness T, the radii of curvature Rv, Rr, the eccentricity E, the angle α, and the sliding distance (ev) satisfy a formula:

$$T>[2\cdot Rv\cdot E/(Rv+Rr)]+d \quad (8)$$

for maintaining the sliding contact surface located at the sliding contact portion between the vane and the roller when the rotary compressor is operated with a large loading, in which L is the height of the vane, E1, E2 are longitudinal elastic coefficients, ν1 and ν2 are Poison's ratios for the vane and the roller, ΔP is a designed pressure, is an effective radius, is a stress from the vane, d is a distance of an elastic contact surface, wherein ρ, ΔP, Fv and d are calculated by following formulae:

$$\frac{1}{\rho}=\frac{1}{Rv}+\frac{1}{Rr} \quad (5)$$

$$Fv=T\cdot L\cdot\Delta P \quad (6)$$

$$d=4\sqrt{\left(\frac{1-\nu_1^2}{\pi E1}+\frac{1-\nu_2^2}{\pi E2}\right)\cdot Fv\cdot\frac{\rho}{L}} \quad (7)$$

When the rotary compressor is operated with a large loading, the designed pressure ΔP is 2.98 Mpa for using an HFC407C freon, 4.14 MPa for using an HFC410A freon, 3.10 MPa for using an HFC404A freon, 1.80 MPa for using an HFC134a freon.

Furthermore, the vane mentioned above is composed of an iron material having a longitudinal elastic coefficient between $1.96\times10^5$~$2.45\times10^5$ N/mm$^2$, and the roller sliding contact with the vane is composed of an iron material having a longitudinal elastic coefficient between $9.81\times10^4$ and $1.47\times10^5$ N/mm$^2$. Preferably, the stokes of the base oil is between 20 and 80 mm2/s at a temperature of about 40° C.

The geometry of the vane and the roller above can be designed where a top surface of the vane can be further coated with a compound layer containing an iron-nitrogen (Fe—N) base, and a diffusion layer with an iron-nitrogen (Fe—N) base formed under the compound layer by nitridation. The top surface of the vane can be alternatively only coated with a compound layer containing an iron-nitrogen (Fe—N) base. The top surface of the vane can also be further coated with a compound layer containing an iron-sulfur (Fe—S) base, and a diffusion layer with an iron-nitrogen (Fe—N) base formed under the compound layer by nitridation.

Furthermore, the top surface of the vane can be coated with a compound layer containing an iron-nitrogen (Fe—N) base, and a diffusion layer containing an iron-nitrogen (Fe—N) base formed under the compound layer by nitridation, and the compound layer with an iron-nitrogen (Fe—N) base coated on at least one side surface of the vane is removed. Alternatively, the top surface of the vane can be further coated with a compound layer containing an iron-sulfur (Fe—S) base, and a diffusion layer with an iron-nitrogen (Fe—N) base is formed under the compound layer by nitridation, but the compound layer containing an iron-sulfur (Fe—S) base coated on at least one side surface of the vane is removed.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1:
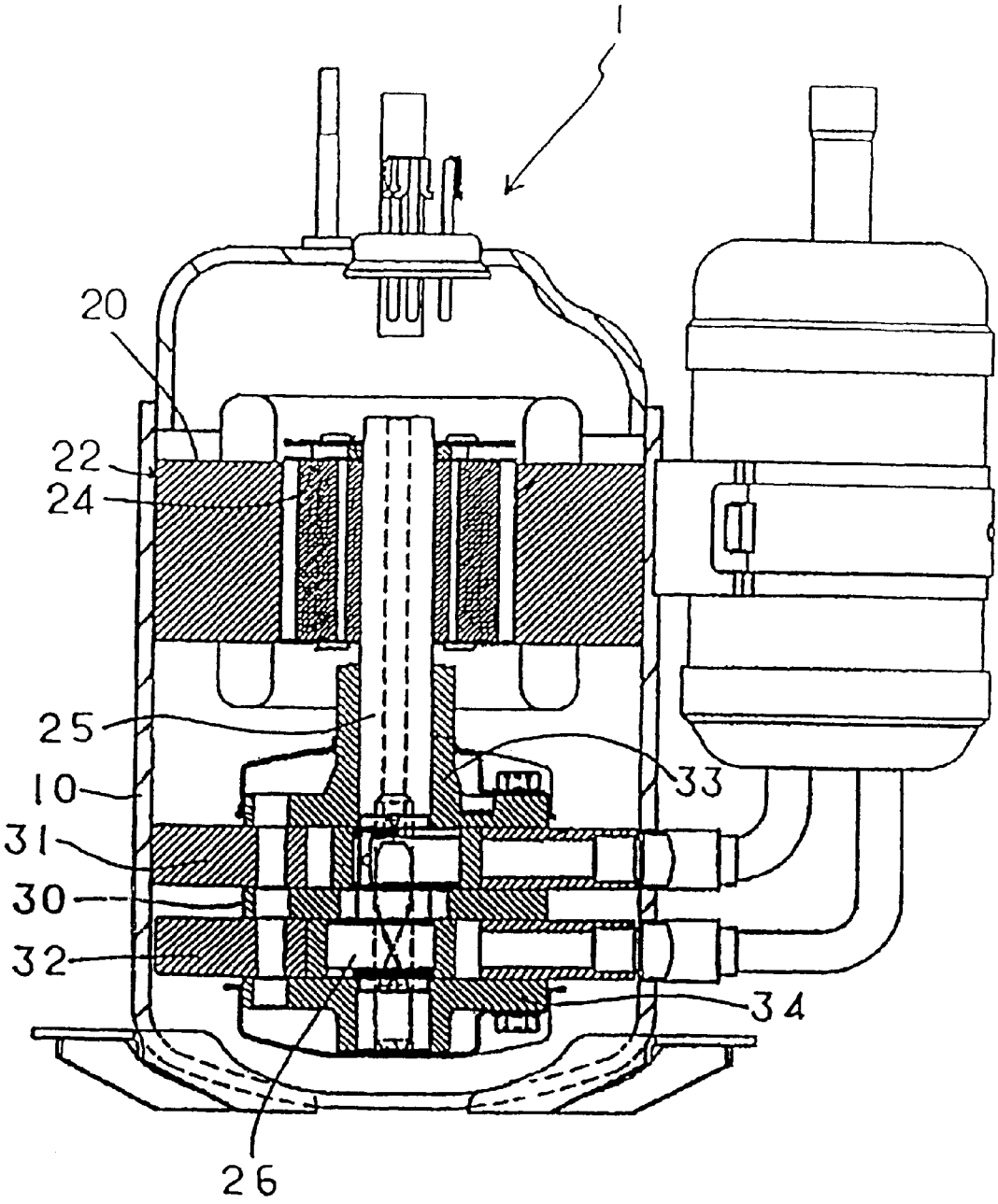
FIG. 1 is a cross-sectional view of a rotary compressor with two cylinders.
Figure 2:
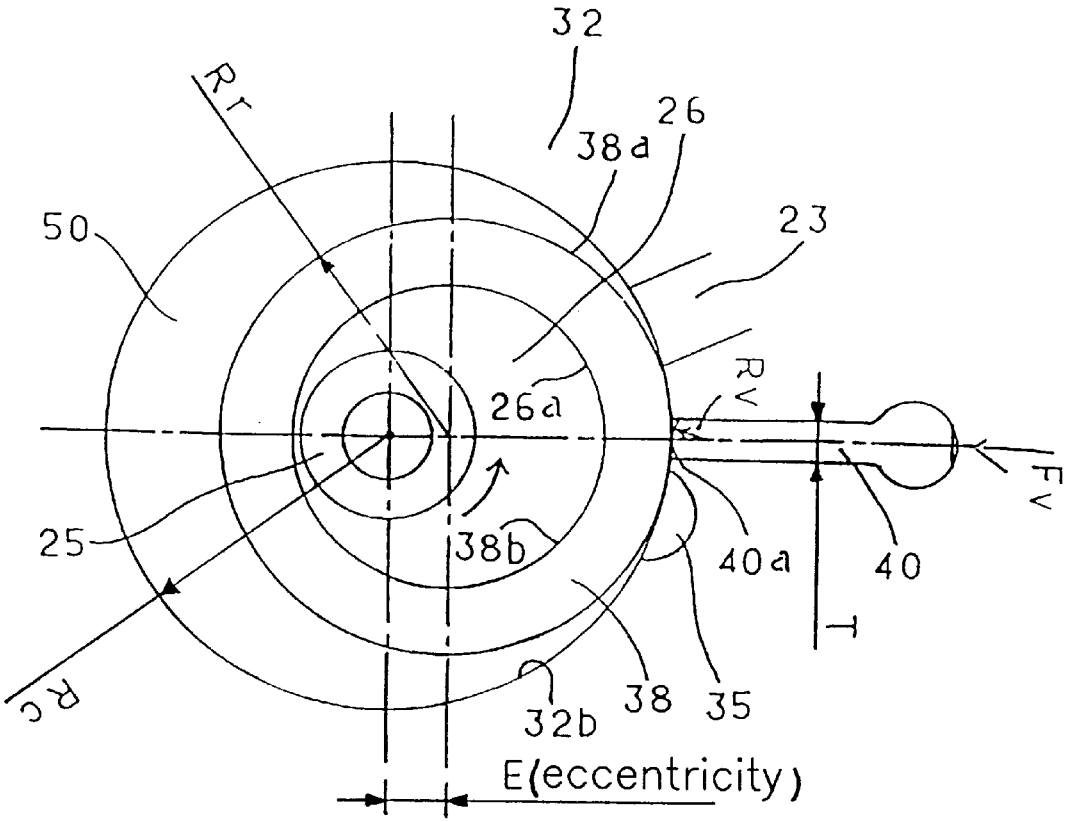
FIG. 2 is a diagram for showing a structural correlation among a roller, a vane and a cylinder in FIG. 1.
Figure 3:
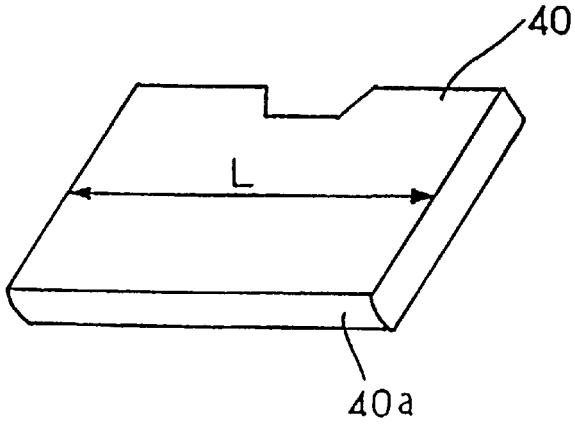
FIG. 3 is a diagram for showing a vane structure in FIG. 1.
Figure 4:
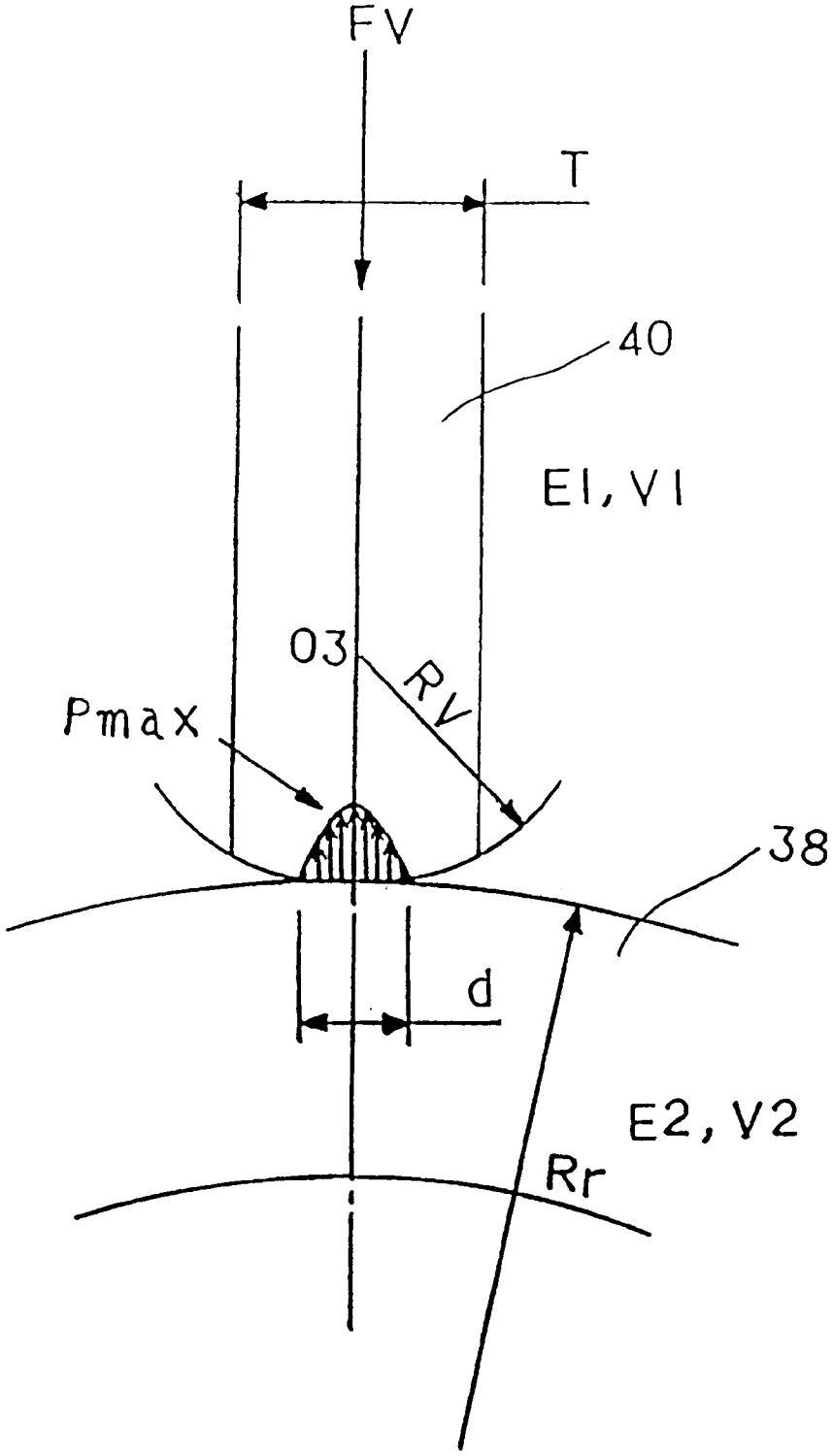
FIG. 4 is a diagram for showing a structural correlation between a roller and a vane of a rotary compressor in FIG. 1.
Figure 6:
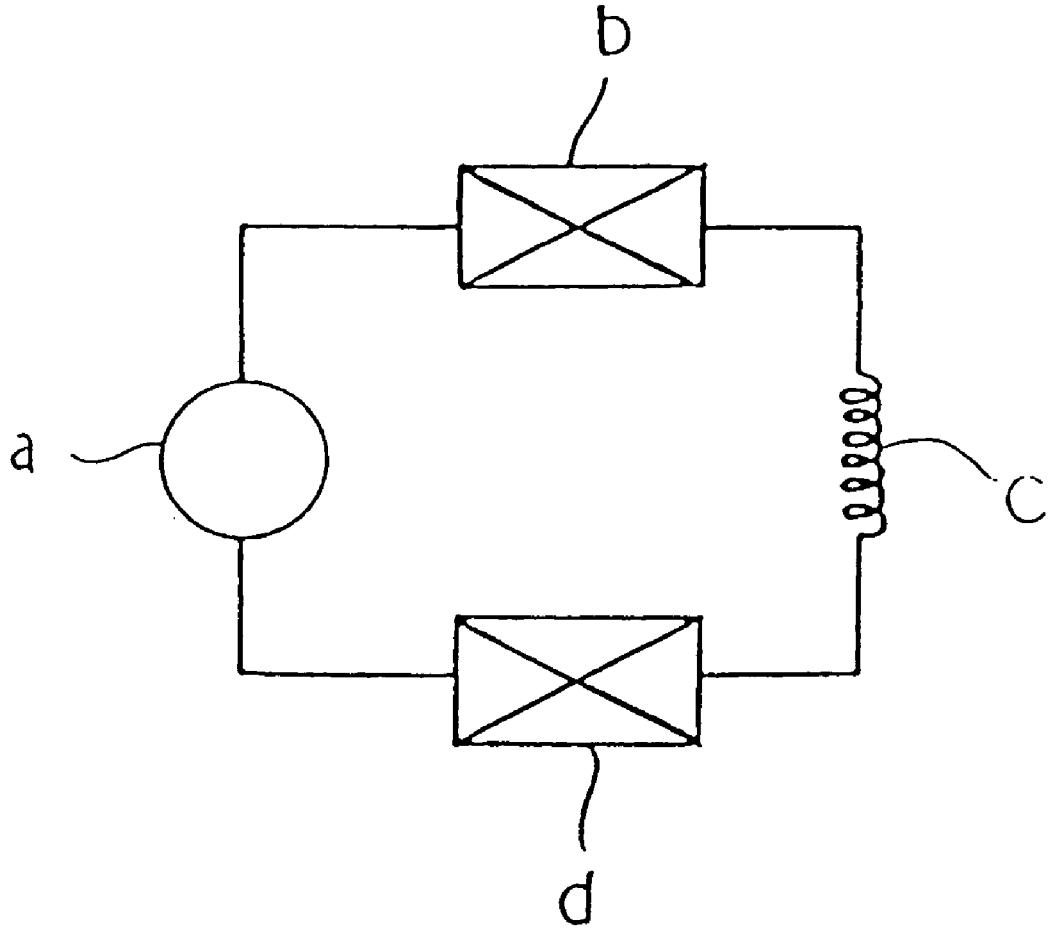
FIG. 6 is a freon loop for a rotary compressor in FIG. 1.

FIG. 6 shows a freon loop suitable for the present invention. The rotary compressor shown in FIG. 1 is also suitable for the present invention. Referring to FIG. 6, the freon loop is used for connecting in turn the rotary compressor a (which uses an HFC freon without containing chlorine ions and uses polyol ester as a lubricant or plyvinyl ether as a base oil of the lubricant), a condenser b for condensing the HFC freon, an expansion device c for reducing the pressure of the HFC freon and an evaporator for evaporating and liquidizing the HFC freon.

Figure 5:
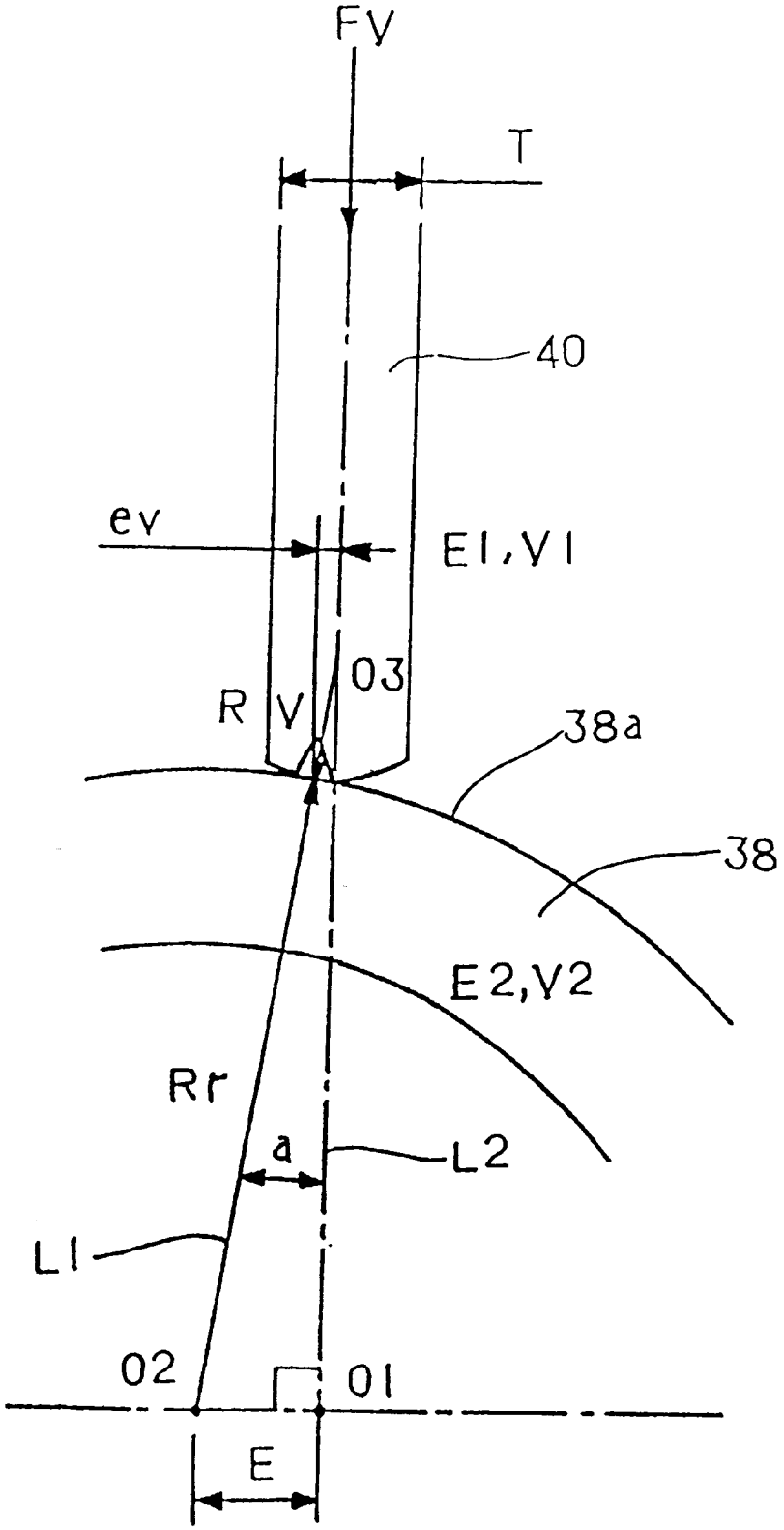
FIG. 5 shows correlations among the center of the rotary shaft of the rotary compressor, the center of the roller and the curvature center of the frond end of the vane.

FIG. 5 shows correlations among the center of the rotary shaft of the rotary compressor, the center of the roller and the curvature center of the front end of the vane. As shown in FIG. 5, the distance between a rotation center (O1) of the rotary shaft 25 and a center (O2) of the roller 38 is defined as an eccentricity (E). An angle is formed between a first line (L1) and a second line (L2), wherein the first line (L1) connects the center (O2) of the roller and the center (O3) of the radius of curvature Rv of the vane 40 while the second line (L2) connects the center (O3) of the radius of curvature Rv of the vane 40 and the rotation center (O1) of the rotary shaft 25. A sliding distance ev connects a first intersection of the first line (L1) with the outer circumference 38*a* of the roller 38 and a second intersection of the second line (L2) with the outer circumference 38*a* of the roller 38. The sliding distance ev can be calculated by the following formula:

$$ev=Rv(E/(Rv+Rr)$$

Next, the radius of curvature Rv of the sliding contact portion between the vane 40 and the roller 38, the thickness of the vane 40, the radius of curvature Rr of the outer circumference 38*a* of the roller 38, the eccentricity E, the longitudinal elastic coefficients E1, E2 of the vane 40 and the roller 38, the Poison's ratios ν1, ν2 of the vane 40 and the roller 38 and the designed pressure ΔP are set.

In addition, the effective radius ρ, the stress Fv from the vane 40, the distance of an elastic contact surface d and the Hertz's stress Pmax are respectively calculated by the above formulae (5), (6), (7) and (9).

For example, if the two-cylinder rotary compressor has a specification that the cylinder is ϕ(inner radius)39 mm×H (height)14 mm, the eccentricity E is 2.88 mm, the exhausting volume is 4.6 cc×2, and the parameters T, Rr, E1, E2, ν1, ν2 and ΔP are values listed in Table I, then the values of ρ·Fv·d·ev·(T−ev−d)/2· Pmax are calculated under the conditions that the radius of curvature Rv is 3.2 mm·4 mm·6 mm·8 mm·10 mm·16.6 mm(same as the radius of curvature Rr and flat. The results are shown in Table I.

TABLE I

| exhausting volume 4.6 cc × 2, cylinder: ϕ39 × H14, eccentricity (E) 2.88 | | | | | | | |
|---|---|---|---|---|---|---|---|
| specification | | | | | | | |
| 1. height of the cylinder (H, mm) | 14.00 | 14.00 | 14.00 | 14.00 | 14.00 | 14.00 | 14.00 |
| 2. thickness of the vane (T, mm) | 3.20 | 3.20 | 3.20 | 3.20 | 3.20 | 3.20 | 3.20 |
| 3. radius of curvature (Rv, mm) | 3.20 | 4.00 | 6.00 | 8.00 | 10.00 | 16.60 | Flat |
| 4. radius of curvature (Rr, mm) | 16.60 | 16.60 | 16.60 | 16.60 | 16.60 | 16.60 | 16.60 |
| 5. eccentricity (E) | 2.880 | 2.880 | 2.880 | 2.880 | 2.880 | 2.880 | 2.880 |
| 6. logitunidal elastic coefficient E1 of the vane (kgf/cm$^2$) | $2.10 \times 10^6$ | $2.10 \times 10^6$ | $2.10 \times 10^6$ | $2.10 \times 10^6$ | $2.10 \times 10^6$ | $2.10 \times 10^6$ | $2.10 \times 10^6$ |
| 7. longitudinal elastic coefficient E2 of the roller (kgf/cm$^2$) | $1.10 \times 10^6$ | $1.10 \times 10^6$ | $1.10 \times 10^6$ | $1.10 \times 10^6$ | $1.10 \times 10^6$ | $1.10 \times 10^6$ | $1.10 \times 10^6$ |
| 8. Poisson's ratio of the vane (ν1) | 0.30 | 0.30 | 0.30 | 0.30 | 0.30 | 0.30 | 0.30 |
| 9. Poisson's ratio of the roller (ν12) | 0.30 | 0.30 | 0.30 | 0.30 | 0.30 | 0.30 | 0.30 |
| 10. designed pressure (ΔP) | 42.00 | 42.00 | 42.00 | 42.00 | 42.00 | 42.00 | 42.00 |
| Result: | | | | | | | |
| 1. compressing stress of the vane Fv (kgf) | 18.816 | 18.816 | 18.816 | 18.816 | 18.816 | 18.816 | 18.816 |
| 2. effectiveradius ρ (cm) | 0.26828 | 0.32233 | 0.4407 | 0.53984 | 0.62406 | 0.83000 | 1.66000 |
| 3. height of the vane (L, cm) | 1.4 | 1.4 | 1.4 | 1.4 | 1.4 | 1.4 | 1.4 |
| 4. distance of the elastic contact surface d (mm) | 0.00481 | 0.00527 | 0.0081 | 0.00683 | 0.00734 | 0.00846 | 0.01197 |
| 5. sliding distance (ev) | 0.93091 | 1.11845 | 1.5292 | 1.87317 | 2.16541 | 2.88000 | — |
| 6. (T-ev-d)/2 (mm) | 1.1343 | 1.04051 | 0.8351 | 0.66307 | 0.51693 | 0.15958 | — |
| 7. Hertz pressure (Pmax) | 35.57 | 32.45 | 27.75 | 25.07 | 23.32 | 20.22 | 14.30 |
| 8. percentage w.r.t Pmax = 35.57 (kgf/mm$^2$, %) | 100 | 91 | 78 | 70 | 66 | 57 | 40 |

As shown in Table I, the percentage of the Hertz's stress Pmax decreases and the sliding distance ev increases when the radius of curvature Rv increases under the condition that the Hertz stress is 100% when T=Rv. At Rv=10 mm, the Hertz stress Pmax is 60%, and the sliding distance ev becomes 2.3-fold. However, at Rv=16.6 mm=Rr, the Hertz stress Pmax is 57% and (T—ev—d) is about 0.16. At the time, it is difficult to maintain the sliding contact surface at the sliding contact portion of the vane 40 and the roller 38.

In addition, if the two-cylinder rotary compressor has a specification that the cylinder is ϕ39 mm×H14 mm, the eccentricity E is 2.35 mm, the exhausting volume is 4.6 cc×2, and the parameters T, Rr, E1, E2, ν1, ν2 and ΔP are values listed in Table II, then the values of ρ·Fv·d·ev·(T− ev−d)/2· Pmax are calculated under the conditions that the radius of curvature Rv is 3.2 mm, 4 mm, 6 mm, 8 mm, 10 mm, 18.1 mm (same as the radius of curvature Rr and flat. The results are shown in Table II.

TABLE II

| exhausting volume 4.6 cc × 2, cylinder: ϕ39 × H14, eccentricity (E) 2.88 | | | | | | | |
|---|---|---|---|---|---|---|---|
| Specification | | | | | | | |
| 1. height of the cylinder (H, mm) | 16.00 | 16.00 | 16.00 | 16.00 | 16.00 | 16.00 | 16.00 |
| 2. thickness of the vane (T, mm) | 3.20 | 3.20 | 3.20 | 3.20 | 3.20 | 3.20 | 3.20 |
| 3. radius of curvature (Rv, mm) | 3.20 | 4.00 | 6.00 | 8.00 | 10.00 | 16.60 | Flat |
| 4. radius of curvature (Rr, mm) | 18.10 | 18.10 | 18.10 | 18.10 | 18.10 | 18.10 | 18.10 |
| 5. eccentricity (E) | 2.350 | 2.350 | 2.350 | 2.350 | 2.350 | 2.350 | 2.350 |
| 6. logitunidal elastic coefficient E1 of the vane (kgf/cm$^2$) | $2.10 \times 10^6$ | $2.10 \times 10^6$ | $2.10 \times 10^6$ | $2.10 \times 10^6$ | $2.10 \times 10^6$ | $2.10 \times 10^6$ | $2.10 \times 10^6$ |
| 7. longitudinal elastic coefficient E2 of the roller (kgf/cm$^2$) | $1.10 \times 10^6$ | $1.10 \times 10^6$ | $1.10 \times 10^6$ | $1.10 \times 10^6$ | $1.10 \times 10^6$ | $1.10 \times 10^6$ | $1.10 \times 10^6$ |
| 8. Poisson's ratio of the vane (ν1) | 0.30 | 0.30 | 0.30 | 0.30 | 0.30 | 0.30 | 0.30 |
| 9. Poisson's ratio of the roller (ν12) | 0.30 | 0.30 | 0.30 | 0.30 | 0.30 | 0.30 | 0.30 |
| 10. designed pressure (ΔP) | 42.00 | 42.00 | 42.00 | 42.00 | 42.00 | 42.00 | 42.00 |
| result | | | | | | | |
| 1. compressing stress of the vane Fv (kgf) | 21.504 | 21.504 | 21.504 | 21.504 | 21.504 | 21.504 | 21.504 |
| 2. effectiveradius ρ (cm) | 0.27192 | 0.32760 | 0.4506 | 0.55479 | 0.64413 | 0.90500 | 1.81000 |
| 3. height of the vane (L, cm) | 1.6 | 1.6 | 1.6 | 1.6 | 1.6 | 1.6 | 1.6 |
| 4. distance of the elastic contact surface d (mm) | 0.00484 | 0.00532 | 0.0062 | 0.00692 | 0.00746 | 0.00884 | 0.01250 |
| 5. sliding distance (ev) | 0.70610 | 0.85068 | 1.1701 | 0.87935 | 0.76333 | 0.42456 | — |
| 6. (T-ev-d)/2 (mm) | 1.24671 | 1.17439 | 1.0146 | 0.37935 | 0.76333 | 0.42456 | — |
| 7. Hertz pressure (Pmax) | 35.50 | 32.19 | 27.44 | 24.73 | 22.95 | 19.38 | 13.69 |
| 8. percentage w.r.t Pmax = 35.57 (kgf/mm$^2$, %) | 100 | 91 | 78 | 70 | 65 | 55 | 39 |

As shown in Table II, the percentage of the Hertz's stress Pmax decreases and the sliding distance ev increases when the radius of curvature Rv increases under the condition that the Hertz stress is 100 % when T=Rv. At Rv=10 mm, the Hertz stress Pmax is 65%, and the sliding distance ev becomes 2.4-fold. However, at Rv=18.1 mm=Rr, the Hertz stress Pmax is 55% and (T—ev—d) is about 0.42. It is therefore difficult to maintain the sliding contact surface at the sliding contact portion of the vane 40 and the roller 38.

Furthermore, if the two-cylinder rotary compressor has a specification that the cylinder is ϕ41 mm×H16 mm, the eccentricity E is 3.478 mm, the exhausting volume is 6.6 cc×2, and the parameters T, Rr, E1, E2, ν1, ν2 and ΔP are values listed in Table III, then the values of ρ·Fv·d·ev·(T—ev—d)/2· Pmax are calculated under the conditions that the radius of curvature Rv is 3.2 mm, 4 mm, 6 mm, 8 mm, 10 mm, 17 mm(same as the radius of curvature Rr and flat. The results are shown in Table III.

TABLE III

| exhausting volume 6.6 cc × 2, cylinder: ϕ41 × H16, eccentricity (E) 3.478 | | | | | | | |
|---|---|---|---|---|---|---|---|
| Specification | | | | | | | |
| 1. height of the cylinder (H, mm) | 16.00 | 16.00 | 16.00 | 16.00 | 16.00 | 16.00 | 16.00 |
| 2. thickness of the vane (T, mm) | 3.20 | 3.20 | 3.20 | 3.20 | 3.20 | 3.20 | 3.20 |
| 3. radius of curvature (Rv, mm) | 3.20 | 4.00 | 6.00 | 8.00 | 10.00 | 16.60 | Flat |
| 4. radius of curvature (Rr, mm) | 17.00 | 17.00 | 17.00 | 17.00 | 17.00 | 17.00 | 17.00 |
| 5. eccentricity (E) | 3.475 | 3.475 | 3.475 | 3.475 | 3.475 | 3.475 | 3.475 |
| 6. logitunidal elastic coefficient E1 of the vane (kgf/cm$^2$) | $2.10 \times 10^6$ | $2.10 \times 10^6$ | $2.10 \times 10^6$ | $2.10 \times 10^6$ | $2.10 \times 10^6$ | $2.10 \times 10^6$ | $2.10 \times 10^6$ |
| 7. longitudinal elastic coefficient E2 of the roller (kgf/cm$^2$) | $1.10 \times 10^6$ | $1.10 \times 10^6$ | $1.10 \times 10^6$ | $1.10 \times 10^6$ | $1.10 \times 10^6$ | $1.10 \times 10^6$ | $1.10 \times 10^6$ |
| 8. Poisson's ratio of the vane (ν1) | 0.30 | 0.30 | 0.30 | 0.30 | 0.30 | 0.30 | 0.30 |
| 9. Poisson's ratio of the roller (ν12) | 0.30 | 0.30 | 0.30 | 0.30 | 0.30 | 0.30 | 0.30 |
| 10. designed pressure (ΔP) | 42.00 | 42.00 | 42.00 | 42.00 | 42.00 | 42.00 | 42.00 |
| result | | | | | | | |
| 1. compressing stress of the vane Fv (kgf) | 21.504 | 21.504 | 21.504 | 21.504 | 21.504 | 21.504 | 21.504 |
| 2. effectiveradius ρ (cm) | 0.26931 | 0.32381 | 0.4434 | 0.54400 | 0.62963 | 0.83000 | 1.66000 |
| 3. height of the vane (L, cm) | 1.6 | 1.6 | 1.6 | 1.6 | 1.6 | 1.6 | 1.6 |
| 4. distance of the elastic contact surface d (mm) | 0.00482 | 0.00529 | 0.0062 | 0.00685 | 0.00737 | 0.00856 | 0.01211 |
| 5. sliding distance (ev) | 1.10099 | 1.32381 | 1.8130 | 2.22400 | 2.57407 | 3.47500 | — |
| 6. (T-ev-d)/2 (mm) | 1.04926 | 0.93783 | 0.6931 | 0.48766 | 0.31259 | −0.13793 | — |
| 7. Hertz pressure (Pmax) | 35.50 | 32.37 | 27.66 | 24.98 | 23.22 | 19.98 | 14.13 |
| 8. percentage w.r.t Pmax = 35.57 (kgf/mm$^2$, %) | 100 | 91 | 78 | 70 | 65 | 56 | 40 |

As shown in Table III, the percentage of the Hertz's stress Pmax decreases and the sliding distance ev increases when the radius of curvature Rv increases under the condition that the Hertz stress is 100% when T=Rv. At Rv=10 mm, the Hertz stress Pmax is 65%, and the sliding distance ev becomes 2.3-fold. However, at Rv=17 mm=Rr, the Hertz stress Pmax is 56% and (T—ev—d) is about −0.14. At the time, it is difficult to maintain the sliding contact surface at the sliding contact portion of the vane 40 and the roller 38.

Alternatively, if the two-cylinder rotary compressor has a specification that the cylinder is ϕ38 mm×H15 mm, the eccentricity E is 4.715 mm, the exhausting volume is 7.65 cc×2, and the parameters T, Rr, E1, E2, ν1, ν2 and ΔP are values listed in Table IV, then the values of ρ·Fv·d·ev·(T—ev—d)/2· Pmax are calculated under the conditions that the radius of curvature Rv is 4.7 mm, 6 mm·8 mm, 10 mm·12 mm, 14.5 mm (same as the radius of curvature Rr and flat. The results are shown in Table IV.

TABLE IV

| exhausting volume 7.65 cc × 2, cylinder: ϕ38 × H15, eccentricity (E): 4.715 | | | | | | | |
|---|---|---|---|---|---|---|---|
| specification | | | | | | | |
| 1. height of the cylinder (H, mm) | 15.00 | 15.00 | 15.00 | 15.00 | 15.00 | 15.00 | 15.00 |
| 2. thickness of the vane (T, mm) | 4.70 | 4.70 | 4.70 | 4.70 | 4.70 | 4.70 | 4.70 |
| 3. radius of curvature (Rv, mm) | 4.70 | 4.00 | 6.00 | 8.00 | 10.00 | 16.60 | Flat |
| 4. radius of curvature (Rr, mm) | 14.50 | 14.50 | 14.50 | 14.50 | 14.50 | 14.50 | 14.50 |
| 5. eccentricity (E) | 4.715 | 4.715 | 4.715 | 4.715 | 4.715 | 4.715 | 4.715 |
| 6. logitunidal elastic coefficient E1 of the vane (kgf/cm$^2$) | $2.10 \times 10^6$ | $2.10 \times 10^6$ | $2.10 \times 10^6$ | $2.10 \times 10^6$ | $2.10 \times 10^6$ | $2.10 \times 10^6$ | $2.10 \times 10^6$ |

TABLE IV-continued

| exhausting volume 7.65 cc × 2, cylinder: ϕ38 × H15, eccentricity (E): 4.715 | | | | | | | |
|---|---|---|---|---|---|---|---|
| 7. longitudinal elastic coefficient E2 of the roller (kgf/cm$^2$) | $1.10 \times 10^6$ | $1.10 \times 10^6$ | $1.10 \times 10^6$ | $1.10 \times 10^6$ | $1.10 \times 10^6$ | $1.10 \times 10^6$ | $1.10 \times 10^6$ |
| 8. Poisson's ratio of the vane (v1) | 0.30 | 0.30 | 0.30 | 0.30 | 0.30 | 0.30 | 0.30 |
| 9. Poisson's ratio of the roller (v12) | 0.30 | 0.30 | 0.30 | 0.30 | 0.30 | 0.30 | 0.30 |
| 10. designed pressure (ΔP) | 18.00 | 18.00 | 18.00 | 18.00 | 18.00 | 18.00 | 18.00 |
| result | | | | | | | |
| 1. compressing stress of the vane Fv (kgf) | 12.690 | 12.690 | 12.690 | 12.690 | 12.690 | 12.690 | 12.690 |
| 2. effectiveradius ρ (cm) | 0.35495 | 0.42439 | 0.51556 | 0.59184 | 0.65660 | 0.72500 | 1.45000 |
| 3. height of the vane (L, cm) | 1.5 | 1.5 | 1.5 | 1.5 | 1.5 | 1.5 | 1.5 |
| 4. distance of the elastic contact surface d (mm) | 0.00439 | 0.00480 | 0.0053 | 0.00567 | 0.00597 | 0.00628 | 0.00887 |
| 5. sliding distance (ev) | 2.30839 | 2.76000 | 3.3528 | 3.84898 | 4.27019 | 4.71500 | — |
| 6. (T-ev-d)/2 (mm) | 1.19559 | 0.96976 | 0.6733 | 0.4253 | 0.21461 | −0.00781 | — |
| 7. Hertz pressure (Pmax) | 24.53 | 22.44 | 20.36 | 19.00 | 18.04 | 17.17 | 12.14 |
| 8. percentage w.r.t Pmax = 35.57 (kgf/mm$^2$, %) | 100 | 91 | 83 | 77 | 74 | 70 | 49 |

As shown in Table IV, the percentage of the Hertz's stress Pmax decreases and the sliding distance ev increases when the radius of curvature Rv increases under the condition that the Hertz stress is 100% when T=Rv. At Rv=12 mm, the Hertz stress Pmax is 74%, and the sliding distance ev becomes 1.9-fold. However, at Rv=14.5 mm=Rr, the Hertz stress Pmax is 70% and (T—ev—d) is about −0.008. It is therefore difficult to maintain the sliding contact surface at the sliding contact portion of the vane 40 and the roller 38.

Therefore, if the radius of curvature of the contact surface of the vane 40 and the roller 38 is within the range T<Rv<Rr, the contact surface of the vane 40 and the roller is maintained to reduce the stress. In addition, the sliding distance increases for diverging the stress such that the temperature at the sliding contact portion between the vane and the roller can be reduced, preventing abnormal abrasion between the vane 40 and the roller 38.

Accordingly, a high-cost coating process is not required to be performed on the surface of the vane 40. Namely, even though a low cost nitridation (NV nitridation, sulphonyl nitridation or radical nitridation) is used, it can sufficiently reduce the abrasion between the outer circumference of the roller and the vane, to further prevent abnormal abrasion.

Furthermore, according to the present invention, if the thickness T of the vane 40 is within the range T>2·Rv·E/(Rv+Rr), the contact surface of the vane 40 and the roller is maintained. In addition, as the thickness T of the vane 40 is within the range T>[2·Rv·E/(Rv+Rr)]+d, even though the rotary compressor is operated with a large loading, the contact surface of the vane 40 and the roller is still securely maintained.

When the rotary compressor is operated with a large loading, the designed pressure ΔP is 2.98 Mpa for using an HFC407C freon, 4.14 MPa for using an HFC410A freon, 3.10 MPa for using an HFC404A freon, 1.80 MPa for using an HFC134a freon. Therefore, considering the elastic deformation for each freon operated with a high loading, it can still maintain the sliding contact surface between two crest lines of the vane in which one is located at the sidewall sliding contact with the cylinder and the other is located at a surface sliding contact with the roller.

The vane 40 is composed of an iron material having the longitudinal elastic coefficient between $1.96\times10^5$~$2.45\times10^5$ N/mm$^2$. If the longitudinal elastic coefficient of the vane is too small, the durability of the vane degrades, and if the longitudinal elastic coefficient of the vane is too large, it cannot keep an excellent elastic deformation. Namely, when the longitudinal elastic coefficient is too large or too small, the stress between the vane and the roller cannot be reduced and the durability degrades.

The top surface of the vane is further coated a compound layer with an iron-nitrogen (Fe—N) base, and a diffusion layer with an iron-nitrogen (Fe—N) base fonned under the compound layer by nitridation. Alternatively, the top surface of the vane is further only coated with a compound layer containing an iron-nitrogen (Fe—N) base. The top surface of the vane can be also coated with a compound layer containing an iron-sulfur (Fe—S) base, and a diffusion layer with an iron-nitrogen (Fe—N) base formed under the compound layer by nitridation. The nitridation and coating for the vane can increase the durability, which is disclosed by JP 10-141269, JP 11-217665, JP-5-73918. However, for the HFC freon, such a nitridation or coating process results in a poor durability.

According to the present invention, the radius of curvature Rv of the sliding contact surface of the vane 40 and the roller 38 is calculated by the formulae (1)~(8) above, and then a vane with a radius of curvature Rv is made. The nitridation above can be further performed on the surface of the vane for obtaining a vane having high durability.

In addition, the top surface of the vane is further coated with a compound layer containing an iron-nitrogen (Fe—N) base, and a diffusion layer containing an iron-nitrogen (Fe—N) base formed under the compound layer by nitridation, and a compound layer with an iron-nitrogen (Fe—N) base coated on at least one side surface of the vane is removed. Alternatively, the top surface of the vane is further coated with a compound layer containing an iron-sulfur (Fe—S) base, and a diffusion layer with an iron-nitrogen (Fe—N) base formed under the compound layer by nitridation, and the compound layer with an iron-sulfur (Fe—S) base coated on at least one side surface of the vane is removed. The nitridation process changes the crystal structure and therefore changes the dimension of the vane. Consequently, a portion of the nitridation coating surfaces of the vane can be further removed.

The roller sliding contact with the vane is composed of an iron material having the longitudinal elastic coefficient between $9.81\times10^4$ and $1.47\times10^5$ N/mm$^2$, for example. If the longitudinal elastic coefficient of the vane is too small, the durability of the vane degrades, and if the longitudinal elastic coefficient of the vane is too large, it cannot keep a suitable elastic deformation. Namely, when the longitudinal elastic coefficient is too large or small the stress between the vane and the roller cannot be reduced and the durability degrades.

According to the present invention, the stocks for the base oil formed by the polyol ester or polyvinyl ether are not restricted. However, the preferred stocks for the base oil is between about 20 and 80 mm$^2$/s at a temperature of 40° C. If the stocks of the base oil is less than 20 mm2/s, it may not prevent the sliding contact portion between the vane and the roller from abrasion, while if the stocks of the base oil is greater than 84 mm2/s, it results in a large power consumption and an uneconomical operation.

The embodiment described above is not used to limit the present invention. Various implementations of the embodiment can be modified to those skilled in the art within the claim scope of the invention.

According to the present invention, the rotary compressor uses a freon without containing chlorine ions, and uses a polyol ester as a lubricant or plyvinyl ether as a base oil. The contact surface of the vane and the roller is then maintained within an acceptable range to reduce the Hertz stress. In addition, the sliding distance increases for diverging the stress such that the temperature at the sliding contact portion between the vane and the roller can be reduced. Thus, these methods prevent abnormal abrasion.

Accordingly, a coating process with high cost is not necessary to be performed on the surface of the vane. Namely, even though a low cost nitridation (NV nitridation, sulphonyl nitridation or radical nitridation) is used, it can sufficiently reduce the abrasion between the outer circumference of the roller and the vane, and further prevent abnormal abrasion.

According to the present invention, the contact surface of the vane and the roller is maintained within an acceptable range such that even though the rotary compressor is operated with a large loading, the contact surface of the vane 40 and the roller is still securely maintained. Considering the elastic deformation for each freon operated with a high loading, it can still maintain the sliding contact surface between two crest lines of the vane in which one is located at the sidewall sliding contact with the cylinder and the other is located at a surface sliding contact with the roller.

In addition, the present invention provides a preferred range for the longitudinal elastic coefficient of the vane. The present invention also provides a preferred range for the longitudinal elastic coefficient of the roller sliding in contact with the vane. Considering the elastic deformation, the stress reduces and the durability of the vane increases.

Furthermore, the present invention provides a preferred design for the sliding contact surface of the vane and the roller. The surface of the vane can be further coated by a low cost nitridation to increase the durability of the vane.

Moreover, the present invention provides a preferred stocks for the base oil at a preferable operational temperature for lowing power consumption and reducing abrasion.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What claimed is:

1. A rotary compressor, coupled to a freon loop connecting in turn to the rotary compressor, a condenser, an expansion device and an evaporator, the rotary compressor using a freon without containing chlorine ions and using polyol ester as a lubricant or plyvinyl ether as a base oil, the rotary compressor comprising:

a cylinder, having a freon inlet and a freon outlet;

a rotary shaft, having a crank installed on an axis of the cylinder;

a roller, installed between the crank and the cylinder, and eccentrically rotating; and a vane, reciprocating within a groove formed in the cylinder, and being in sliding contact with an outer circumference of the roller, wherein the sliding contact portion between the vane and the roller has a radius of curvature Rv satisfying the following formula:

$$T<Rv<Rr$$

wherein T is the thickness of the vane and Rr is the radius of curvature of the outer circumference of the roller sliding contact with the vane.

2. The rotary compressor of claim 1, wherein a distance between a rotation center (O1) of the rotary shaft and a center (O2) of the roller is defined as an eccentricity (E), an angle cc is formed between a first line (L1) connecting the center (O2) of the roller and a center (O3) of the radius of curvature Rv and a second line (L2) connecting the center (O3) of the radius of curvature Rv of the vane and the rotation center (O1) of the rotary shaft, and a sliding distance (ev) is defined as the distance connecting a first intersection of the first line (L1) with the outer circumference of the roller and a second intersection of the second line (L2) with the outer circumference of the roller, wherein the thickness T, the radii of curvature Rv, Rr, the eccentricity E, the angle$\alpha$, and the sliding distance (ev) satisfy the following formulae for maintaining a sliding contact surface located at the sliding contact portion between the vane and the roller:

$$T>2\cdot Rv\cdot E/(Rv+Rr)$$

$$\sin\alpha=E/(Rv+Rr)$$

$$ev=Rv\cdot E/(Rv+Rr).$$

3. The rotary compressor of claim 1, wherein the thickness T, the radii of curvature Rv, Rr, the eccentricity E, the angle $\alpha$, and the sliding distance (ev) satisfy a formula, $T>[2\cdot Rv\cdot E/(Rv+Rr)]+d$, for maintaining the sliding contact surface located at the sliding contact portion between the vane and the roller when the rotary compressor is operated with a large loading in which L the height of the vane, E1, E2 are longitudinal elastic coefficients, v1 and v2 are Poison's ratios for the vane the roller, $\Delta P$ is a designed pressure, $\rho$ is an effective radius, Fv is a stress from the vane, and d is a distance of an elastic contact surface, wherein $\rho$, $\Delta P$, Fv and d are calculated by following formulae:

$$\frac{1}{\rho} = \frac{1}{Rv} + \frac{1}{Rr}$$

$$Fv = T \cdot L \cdot \Delta P$$

$$d = 4\sqrt{\left(\frac{1-\nu_1^2}{\pi E1} + \frac{1-\nu_2^2}{\pi E2}\right) \cdot Fv \cdot \frac{\rho}{L}}\,.$$

4. The rotary compressor of claim 1, wherein when the rotary compressor is operated with a large loading, the designed pressure ΔP is 2.98 Mpa for using an HFC407C freon, 4.14 MPa for using an HFC410A freon, 3.10 MPa for using an HFC404A freon, 1.80 MPa for using an HFC134a freon.

5. The rotary compressor of claim 1, wherein the vane is composed of an iron material having a longitudinal elastic coefficient of between $1.96\times10^5$~$2.45\times10^5$ N/mm$^2$.

6. The rotary compressor of claim 5, wherein a top surface of the vane is further coated with a compound layer composed of an iron-nitrogen (Fe—N) base, and a diffusion layer with an iron-nitrogen (Fe—N) base formed under the compound layer by nitridation.

7. The rotary compressor of claim 5, wherein a top surface of the vane is further only coated with a compound layer containing an iron-nitrogen (Fe—N) base.

8. The rotary compressor of claim 5, wherein a top surface of the vane is further coated with a compound layer containing an iron-sulfur (Fe—S) base, and a diffusion layer with an iron-nitrogen (Fe—N) base formed under the compound layer by nitridation.

9. The rotary compressor of claim 6, wherein the top surface of the vane is further coated with a compound layer containing an iron-nitrogen (Fe—N) base, and the diffusion layer with an iron-nitrogen (Fe—N) base formed under the compound layer by nitridation, and the compound layer with an iron-nitrogen (Fe—N) base coated on at least one side surface of the vane is removed.

10. The rotary compressor of claim 8, wherein a top surface of the vane is further coated with a compound layer containing an iron-sulfur (Fe—S) base, and a diffusion layer containing an iron-nitrogen (Fe—N) base formed under the compound layer by nitridation, and the compound layer containing an iron-sulfur (Fe—S) base coated on at least one side surface of the vane is removed.

11. The rotary compressor of claim 1, wherein the roller sliding contact with the vane is composed of an iron material having a longitudinal elastic coefficient between $9.81\times10^4$ and $1.47\times10^5$ N/mm$^2$.

12. The rotary compressor of claim 1, wherein the stokes of the base oil is between 20 and 80 mm$^2$/s at 40° C.

* * * * *